US010900307B2

(12) United States Patent
Al Hussin et al.

(10) Patent No.: US 10,900,307 B2
(45) Date of Patent: Jan. 26, 2021

(54) LINEAR ACTUATOR WITH HYDRAULIC FEED THROUGH

(71) Applicant: C6 TECHNOLOGIES AS, Stavanger (NO)

(72) Inventors: Husam Al Hussin, Sandnes (NO); Jeff Wensrich, Stavanger (NO)

(73) Assignee: C6 TECHNOLOGIES AS, Stavanger (NO)

( * ) Notice: Subject to any disclaimer, the term of this patent is extended or adjusted under 35 U.S.C. 154(b) by 50 days.

(21) Appl. No.: 16/335,592

(22) PCT Filed: Nov. 18, 2016

(86) PCT No.: PCT/NO2016/050233

§ 371 (c)(1),
(2) Date: Mar. 21, 2019

(87) PCT Pub. No.: WO2018/093267

PCT Pub. Date: May 24, 2018

(65) Prior Publication Data

US 2020/0024918 A1 Jan. 23, 2020

(51) Int. Cl.
*E21B 23/04* (2006.01)
*E21B 34/06* (2006.01)
(Continued)

(52) U.S. Cl.
CPC ..... *E21B 23/04* (2013.01); *E21B 23/042* (2020.05); *E21B 34/06* (2013.01); *E21B 34/10* (2013.01);
(Continued)

(58) Field of Classification Search
CPC ..... E21B 23/04; E21B 23/042; E21B 34/06; E21B 34/10; E21B 34/101
See application file for complete search history.

(56) References Cited

U.S. PATENT DOCUMENTS 6,439,321 B1 8/2002 Gillis et al.
7,240,737 B2 7/2007 Tips
(Continued)

FOREIGN PATENT DOCUMENTS

EP 1 602 833 A2 12/2005
EP 1 686 267 A1 8/2006
FR 2.024.747 9/1970

OTHER PUBLICATIONS

International Preliminary Report on Patentability, issued in PCT/NO2016/050233, dated Nov. 5, 2018.
(Continued)

*Primary Examiner* — Tara Schimpf
(74) *Attorney, Agent, or Firm* — Birch, Stewart, Kolasch & Birch, LLP

(57) ABSTRACT

Hydraulic fluid is from a hydraulic pump to a tool connected to respective first and second ends of a wellbore linear actuator. The actuator has a double acting cylinder with a cylinder head, a cylinder cap opposite the cylinder head, a piston head, and a piston rod. The piston head separates the cylinder into a first chamber and a second chamber, and the piston rod extends out of the second chamber through the cylinder cap. The double acting cylinder has first and second ends, and the double acting cylinder further includes a feed fluid passage between the first and second ends. The feed fluid passage includes a first fluid line through the piston head and the piston rod, the first chamber, and a second fluid line through the cylinder head.

25 Claims, 4 Drawing Sheets

(51) Int. Cl.

| | |
|---|---|
| ***E21B 34/10*** | (2006.01) |
| *E21B 47/12* | (2012.01) |
| *F15B 15/14* | (2006.01) |
| *F15B 15/18* | (2006.01) |

(52) U.S. Cl.
CPC ..... *E21B 34/101* (2013.01); *E21B 47/12* (2013.01); *F15B 15/149* (2013.01); *F15B 15/1457* (2013.01); *F15B 15/18* (2013.01)

(56) References Cited

U.S. PATENT DOCUMENTS

| | | | | |
|---|---|---|---|---|
| 7,743,833 | B2 * | 6/2010 | Cascario | E21B 34/10 166/375 |
| 9,027,650 | B2 | 5/2015 | Radford et al. | |
| 2017/0074068 | A1 * | 3/2017 | Kucera | E21B 34/101 |
| 2017/0107789 | A1 * | 4/2017 | Gostkowski | E21B 34/06 |

OTHER PUBLICATIONS

International Search Report, issued in PCT/NO2016/050233, dated Aug. 2, 2017.
Written Opinion of the International Searching Authority, issued in PCT/NO2016/050233, dated Aug. 2, 2017.

* cited by examiner

LINEAR ACTUATOR WITH HYDRAULIC FEED THROUGH

FIELD OF THE INVENTION

The invention is in the field of wellbore downhole tools technology. More specifically it is related to a linear actuator to be run in oil and gas wells as part of a wireline operated tool string to perform intervention operations.

BACKGROUND ART

Well intervention is a broad topic covering operations in oil or gas wells that are still operational, i.e. able to deliver gas or oil. Intervention operations will typically be carried out to improve the quality or extend the production life of the wellbore.

Wireline tools are increasingly used for a wide variety of wellbore interventions, since only a minimum of equipment and personnel is required to perform the intervention. Intervention operations can be performed both in open-hole and cased wellbores, where some examples of such operations can be replacing equipment in the well such as pumps, valves etc. adjusting or repairing such equipment, fishing operations, monitoring well parameters, well reconfiguration etc.

EP 1686267 A1 describes bidirectional linear actuator with an inner slide member.

U.S. Pat. No. 7,240,737 B2 describes a system for controlling operation of a downhole tool with an actuator. A control system member is disposed at a location remote from the actuator. A displacement of the control system member causes a displacement of the actuator member, the control system member displacement being proportional to the actuator member displacement.

U.S. Pat. No. 6,439,321 B1 discloses an actuator for an orienting device for orienting a borehole apparatus in a borehole, wherein the orienting device is comprised of an orienting mechanism which is actuated by longitudinal movement. The actuator is comprised of a housing having a first end and a second end and a fluid passageway extending through the housing from the first end to the second end. Further, a longitudinally reciprocable piston, positioned within and providing a first partial obstruction of the fluid passageway, engages with the orienting mechanism such that longitudinal movement of the piston actuates the orienting mechanism.

U.S. Pat. No. 9,027,650 B2 describes an apparatus with a downhole device and an actuation device for e.g. activating and de-activating a reamer. A housing includes an annular chamber housing a first fluid therein and a piston in the annular chamber that divides the annular chamber into a first section and a second section. The piston is to a biasing member. A control unit enables movement of the first fluid from the first section to the second section to supply a second fluid under pressure to the tool to move the tool into an active position and from the second section to the first section to stop the supply of the second fluid to the tool to cause the tool to move into an inactive position.

The prior art above discloses some devices and principles for activation and de-activation of a wellbore tool. However, they fail to disclose a linear actuator that can be used to position the intervention tool, and at the same time providing power and control means for the tool.

SHORT SUMMARY OF THE INVENTION

A main object of the present invention is therefore to disclose a wellbore linear actuator that can hold and position a tool or device, and at the same time provide power and control means to the tool.

In this way, the linear actuator according to the invention can be seen as a positioning device that is transparent for the power and control signals, and the attached tool can perform its operation as an autonomous unit, independent of the linear actuator, once positioned.

In an embodiment, the invention is therefore a wellbore linear actuator comprising;

- a double acting cylinder with a cylinder bore, wherein the double acting cylinder comprises
- a cylinder head,
- a cylinder cap opposite the cylinder head,
- a piston head, and
- a piston rod, wherein
- the piston head separates the cylinder bore into a first chamber and a second chamber, and the piston rod extends out of the second chamber through the cylinder cap, wherein the double acting cylinder has a first end at the cylinder head and a second end at the external end of the piston rod, wherein the double acting cylinder further comprises;
- a feed fluid passage between the first and second ends, wherein the feed fluid passage comprises;
- a first fluid line through the piston head and the piston rod, the first chamber, and
- a second fluid line through the cylinder head.

The invention is also a method for providing hydraulic fluid from a hydraulic pump to a tool connected to respective first and second ends of such a wellbore linear actuator, comprising the steps of;

- closing a fluid passage between the first chamber and the tool and opening a fluid passage between the hydraulic pump and the first chamber to expand the wellbore linear actuator into position,
- opening the fluid passage between the first chamber and the tool to provide hydraulic fluid to the tool.

According to the disclosed invention a single fluid circuit can be used for operation of the linear actuator itself, as well as for feeding tools connected to the linear actuator. Thus, a single pump and a single distribution circuit can be used to achieve the two functions. This reduces the complexity of the system and increases efficiency and power, since space is limited by the wellbore diameter.

With less active components such as pumps and valves, a further advantage is that the linear actuator can be made more reliable than systems that require additional components.

The wellbore linear actuator can be used with different types of tools, since the linear actuator provides a well-defined tool interface. Any tool that adheres to this interface can be used with the linear actuator. This interface is mechanical in that it secures the tool to the linear actuator. It is hydraulic since it provides a hydraulic port with fluid under pressure available for the tool. It can in an embodiment be electric, since it provides electric power to the tool, and it can in an embodiment comprise a control interface for controlling the tool.

FIGURE CAPTIONS

The attached figures illustrate some embodiments of the claimed invention.

EMBODIMENTS OF THE INVENTION

The invention will in the following be described and embodiments of the invention will be explained with reference to the accompanying drawings.

Figure 1:
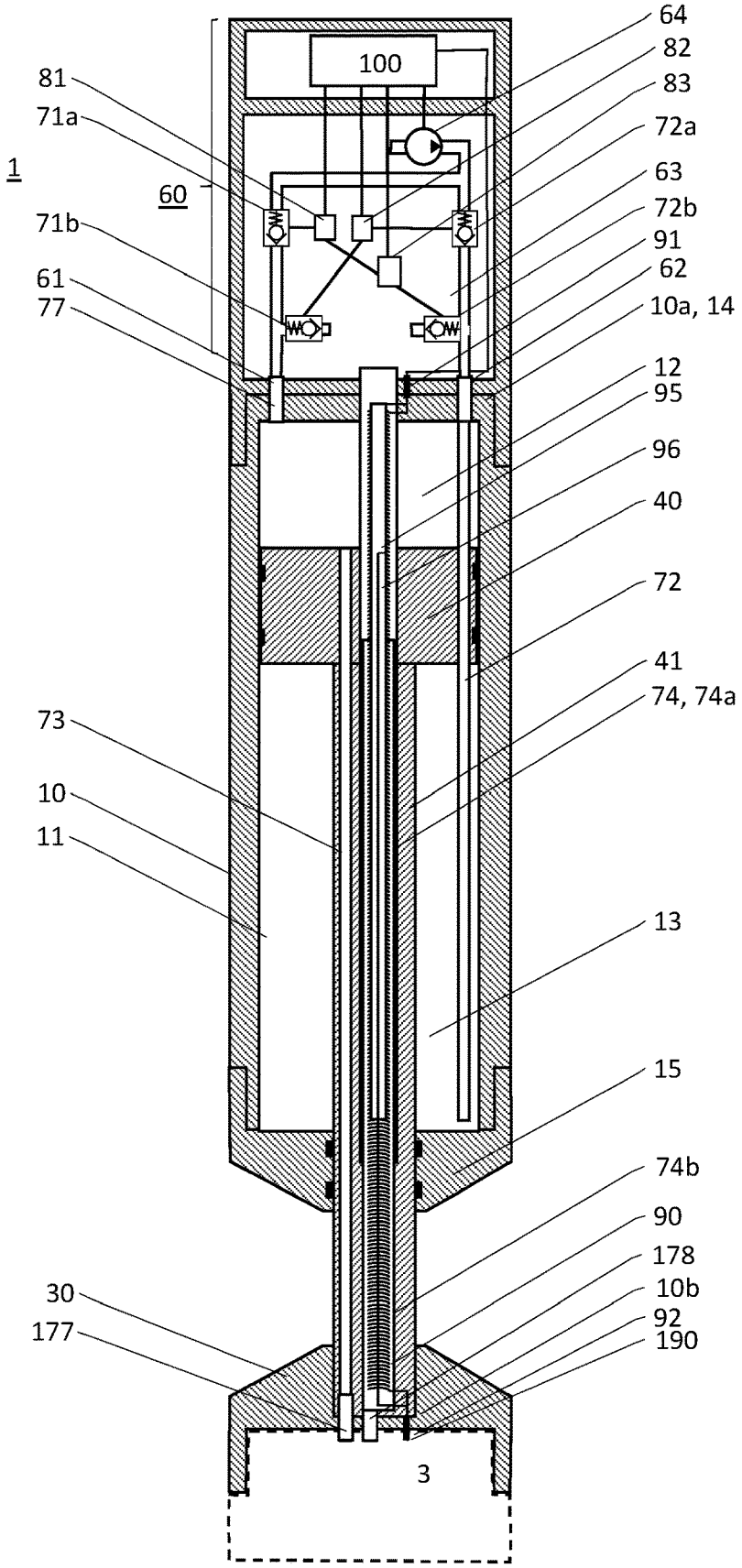
FIG. 1 illustrates in a section view, a wellbore linear actuator according to an embodiment of the invention.
Figure 2:
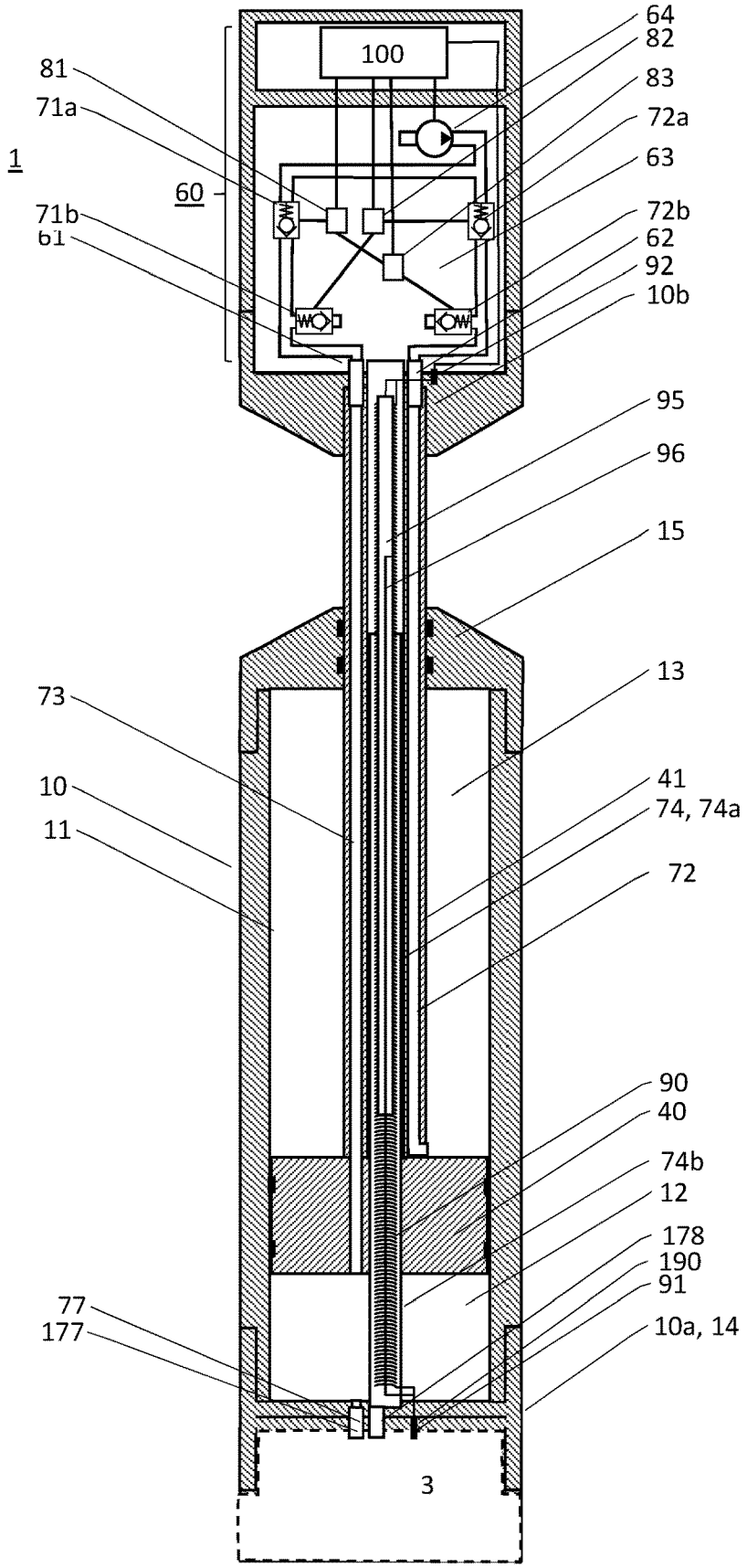
FIG. 2 illustrates in a section view, a wellbore linear actuator according to an embodiment of the invention.

FIGS. 1 and 2 illustrate the main features of an embodiment of the invention. The cylinder (10) of the wellbore linear actuator (1) has an internal cylinder bore (11). Inside the cylinder bore (11), a piston head (40) connected to a piston rod (41) can travel between the cylinder head (14) and the cylinder cap (15). The piston head (40) separates the cylinder bore (11) into a first chamber (12) and a second chamber (13), and the piston rod (41) extends out of the second chamber through the cylinder cap (15).

In the following the cylinder head (14) end will be defined as the first end (10*a*) and the far end of the piston rod (41) will be defined as the second end (10*b*). When the cylinder is extending, the distance between the first and second ends (10*a*, 10*b*) will therefore increase, and when the cylinder is retracting, the distance between the first and second ends (10*a*, 10*b*) will decrease.

The thrust or pull of the linear actuator (1) can be determined by the difference in pressure in the first and second chambers (12, 13) multiplied by the respective effective piston surface area, according to Pascal's law.

The double acting cylinder (10) further comprises a fluid passage all the way between the first and second ends (10*a*, 10*b*), i.e. between the cylinder head (14) and the far end of the piston rod (41). This fluid passage is comprised of at least three different sections. Starting from the bottom in FIG. 1, and from the top in FIG. 2, the first section is a first fluid line (73) through the piston head (40) and the piston rod (41). The second section is the first chamber (12), and the third section is a second fluid line (77) through the cylinder head (14). Thus, the first fluid line (73) interconnects the second end (10*b*) of the cylinder, i.e. the end of the piston rod (41) with the first chamber (12), and the second fluid line (77) interconnects the first chamber (12) with the first end of the cylinder (10*a*) to provide a hydraulic feed through from a hydraulic source arranged on one end of the double acting cylinder (10) to a tool (3) arranged on the opposite end. The wellbore linear actuator (1) of the invention, has, in an embodiment related to the embodiment above, a tool drain line (74), as illustrated in FIGS. 1 and 2, between the first and second ends (10*a*, 10*b*). The tool drain line (74) is arranged through the cylinder head (14), the piston head (40), and the piston rod (41) and comprises first and second telescoping tubular elements (74*a*, 74*b*). One of the first and second telescoping elements (74*a*, 74*b*) is fixed relative the first end (10*a*), while the other is fixed relative the second end (10*b*).

The tool drain line (74) allows low pressure fluid to flow back from the tool (3) to a reservoir (63) or similar on the opposite side of the double acting cylinder (10). In FIGS. 1 and 2 the reservoir (63) is illustrated as a hydraulic chamber with hydraulic components. However, it might well also be separate tank or another suitable device.

In an embodiment, the invention comprises an actuate fluid port (61), arranged at the first or second end (10*a*, 10*b*), and the first or second end (10*a*, 10*b*), opposite the fluid port (61), is arranged for holding a downhole tool (3) to allow connection to a hydraulic system above the fluid port (61) and linear actuator feed-through of hydraulic fluid from the actuate fluid port (61) to the downhole tool (3).

In an embodiment, the wellbore linear actuator comprises a fluid pump (64), and a fluid control circuit (60) interconnecting the fluid pump (64) and the actuate fluid port (61). The fluid control circuit (61) is further arranged for opening and closing the fluid passage between the fluid pump (64) and the first chamber (12). This will, when the fluid passage is open, provide pressurized fluid to the first chamber (12) and to the tool (3). This will allow the actuator to extend and to feed pressurized fluid into the tool. The actual behavior of the system in such a case will be explained below.

In an embodiment, the wellbore linear actuator (1) comprises a fluid reservoir (63), and the fluid control circuit (60) interconnects the fluid reservoir (63) and the actuate fluid port (61). Further, the fluid control circuit (60) is arranged for simultaneously opening a drain fluid passage between the fluid reservoir (63) and the first chamber (12) and for closing the fluid passage between the fluid pump (64) and the first chamber (12). This action will allow the fluid in the first chamber (12) and the first fluid line (73) to flow back into the reservoir (63) if the linear actuator should be retracted.

In an embodiment, the control circuit (60) comprises an actuate valve (71*a*) that is arranged for opening and closing the fluid passage between the fluid pump (64) and the first chamber (12), as mentioned above.

Further, the control circuit (60) comprises, in an embodiment, an actuate drain valve (71*b*) arranged for opening and closing the drain fluid passage between the fluid reservoir (63) and the first chamber (12), as mentioned above.

The embodiments above have been related to the active expansion of the double acting cylinder (10), and also passive retract by allowing fluid to flow back to the reservoir.

For active retract, the wellbore linear actuator (1) comprises in an embodiment, that can be combined with any of the embodiments above, a retract fluid port (62) arranged at the first or second end (10*a*, 10*b*). In FIG. 1, the retract fluid port is arranged at the first end (10*a*), and in FIG. 2, the retract fluid port is arranged at the second end (10*b*). The double acting cylinder (10) further comprises a retract fluid passage between the retract fluid port (62) and the second chamber (13).

In a specific embodiment with regard to the embodiment above, the fluid control circuit (60) interconnects the fluid pump (64) and the retract fluid port (62) and is arranged for opening and closing the retract fluid passage between the fluid pump (64) and the second chamber (13) to actively retract the double acting cylinder (10) when the retract fluid passage is open. This can be achieved by a retract valve (72*a*) arranged for opening and closing the retract fluid passage. This will, when the retract fluid passage is open, provide pressurized fluid to the second chamber (13), and allow the actuator to retract.

Further, the control circuit (60) may comprise a retract drain valve (72*b*) arranged for opening and closing a retract drain fluid passage between the fluid reservoir (63) and the second chamber (13).

In an embodiment, the fluid control circuit (60) is further arranged for simultaneously opening the retract drain fluid passage between the fluid reservoir (63) and the second chamber (13) and for closing the fluid passage between the fluid pump (64) and the second chamber (13) to allow the double acting cylinder (10) to extend.

In order to expand and retract the wellbore linear actuator (1) and to provide pressurized fluid to the tool, the fluid control circuit (60) may operate the valves (71*a*, 71*b*, 72*a*, 72*b*) as explained below.

In an embodiment, the fluid control circuit (60) is arranged for simultaneously opening the actuate valve (71*a*) and the retract drain valve (72*b*) and for closing the retract valve (72*a*) and the actuate drain valve (71*b*) to extend the double acting cylinder (10). This will open a fluid passage between the pump (64) and the first chamber (12), and another fluid passage between the reservoir (63) and the second chamber (13). In this way the pressurized fluid from the pump (64) will be pumped into the first chamber (12) and the fluid in the second chamber (13) will be pressed into the reservoir (63).

To actively retract the wellbore linear actuator (1) the fluid control circuit (60) is arranged for simultaneously opening the retract valve (72*a*) and the actuate drain valve (71*b*) and for closing the actuate valve (71*a*) and the retract drain valve (72*b*) to retract the double acting cylinder (10). The pressurized fluid from the pump (64) will be pumped into the second chamber (13) and the fluid in the first chamber (13) will be pressed into the reservoir (63).

The wellbore linear actuator (1) will in an embodiment be able to feed hydraulic fluid from the pump (64) to the tool (3) fixed to the wellbore linear actuator (1). In this embodiment, the fluid control circuit (60) is arranged for opening the fluid passage between the pump (64) and the first chamber (12) and for closing all other passages mentioned above in the control circuit (60), i.e. the drain fluid passage between the first chamber (12) and the reservoir (63), the retract fluid passage between the pump (64) and the second chamber (13) and the retract drain fluid passage between the second chamber (13) and the reservoir (63). In an embodiment with the valves mentioned previously, this corresponds to opening the actuate valve (71*a*) and closing the actuate drain valve (71*b*), the retract valve (72*a*), and the retract drain valve (72*b*). In this valve configuration the position of the piston (40) is locked, since the fluid on the retract side is trapped inside a closed circuit. Hydraulic fluid under pressure can therefore be provided to the tool (3) through the same fluid lines that are used for expanding and positioning the second end (10*b*) of the wellbore linear actuator (1).

In an embodiment, the valves are controlled by hydraulic solenoid valves. In this embodiment, the fluid control means (80) comprises a retract solenoid valve (82) arranged to control the retract valve (72*a*) and the actuate drain valve (71*b*). Thus, since these valves operate in pair, they can be controlled by a common solenoid valve.

Further, a tool pressure solenoid valve (83) is arranged to enable or disable opening of the retract drain valve (72*b*), and an actuate solenoid valve (81) is arranged to control the actuate valve (71*a*) and the retract drain valve (72*b*) when the retract drain valve (72*b*) is opened, and control the actuate valve (71*a*) when the retract drain valve (72*b*) is closed. Thus, the position of the tool pressure solenoid valve (83) has priority over the position of the retract solenoid valve (82), so that as long as the tool pressure solenoid valve (83) is closed, or disabled, the actuate drain valve (71*b*) will stay closed.

Three operational states may then be controlled by opening and closing these valves;

First, expansion is achieved by opening the actuate solenoid valve (81) and closing the retract solenoid valve (82).

Second, retraction is achieved by closing the actuate solenoid valve (81) and opening the retract solenoid valve (82).

Third, hydraulic feed through is activated by opening the actuate solenoid valve (81) and closing the retract solenoid valve (82) and the tool pressure solenoid valve (83).

In order to control the operation of the wellbore linear actuator, it comprises in an embodiment, an actuator control system (100) connected to the solenoid valves. The solenoids may be controlled from the control system via electrical or hydraulic control lines. The control system may also be responsible for controlling the hydraulic pump (4). The control system may be arranged in a separate compartment as illustrated in FIGS. 1 and 2. It may also be distributed over several physical locations in the wellbore linear actuator (1), as well as in other parts of the tool string the actuator is part of. The control system (100) will typically be in communication with a surface control system not shown in the figures.

In an embodiment, the wellbore linear actuator comprises an electric feed through for feeding electric energy to the tool (3) and bidirectional signals to/from the tool (3). In this embodiment, it comprises an electric connection (90) through the first and second telescoping tubular elements (74*a*, 74*b*), interconnecting first and second electric terminations (91, 92) arranged in the first and second ends (10*a*, 10*b*), respectively. The electric terminations have been illustrated as filled boxes in the drawings. The electric feed through connection can comprise any type of wire or cable suitable for the intended purpose, such power cables and signal cables.

In an embodiment, the electric connection (90) is a stretchable helical wire comprising e.g. the power and signal cables. The helical wire will stretch when the double acting cylinder expands, and retract when the cylinder retracts. Since the wire is confined by the tubular elements (74*a*, 74*b*) it will stay in place during operation.

The tool (3) attached to the linear actuator (1) may require accurate positioning to be able to perform the required operation. In an embodiment, the wellbore linear actuator (1) therefore comprises a telescopic position sensor (95), arranged through the first and second telescoping tubular elements (74*a*, 74*b*), and arranged to provide an output value corresponding to a longitudinal position of the piston head (40) within the cylinder bore (11). This will correspond to the displacement of the tool (3) relative a reference position, e.g. the fully retracted position of the linear actuator (1). Other relative references may be used to indicate the position of the tool relative the opposite end of the cylinder.

In an embodiment, the telescopic position sensor (95) is a potentiometer, where the relative position is indicated by resistance of the potentiometer. A sliding contact, or wiper (96) is indicated in FIGS. 1 and 2. Since the potentiometer is in essence a voltage divider when it appears in an electric circuit, the relative position will be indicated by the voltage between an end contact and the wiper (96). In the embodiment shown, the wiper pin constitutes the inner element of the telescopic position sensor (95) and is fixed in the end opposite the sliding contact to the second end (10*a*) in FIG. 1 and to the first end (10*a*) in FIG. 2. The actual fixture is not shown in the figures, but it should allow passage of fluid through the tool drain line (74).

In the case where a helical wire is used for electric feed through, the telescopic position sensor (95) is arranged in the middle of the helical wire. The wiper (96) may be electrically connected to the end of the electric connection (90) and in this way become available to an electric control circuit above the linear actuator.

The other end of the position sensor (95), i.e. the outer telescopic element opposite the termination of the wiper is electrically terminated in the first electric termination (91) in FIG. 1 and the second electric termination (92) in FIG. 2. Thus, both ends of the potentiometer will be available from the same electric termination (91 or 92), and can be further connected to a control system, such as the actuator control system (100), where the position of the tool can be determined and used as an input parameter to the control loop for control of the linear actuator.

In an embodiment, the linear actuator (1) comprises a tool adapter (30) fixed to the first or second end (10*a*, 10*b*) of the linear actuator (1). The tool adapter (30) is arranged for releasably holding the tool (3). The tool adapter (30) can in this embodiment be seen as a socket where corresponding terminations of the tool (3) are connected to the hydraulic and electric terminations of the linear actuator described previously. Further, the tool adapter (30) has fixing means to hold the tool, such as threads, pins, bolts or similar. The tool adapter (30) provides a tool interface that allows different tools to be connected to the same linear actuator, provided they have the required characteristics of the tool interface. In FIGS. 1 and 2, the connectors of the tool interface are illustrated. I.e., the hydraulic high pressure connector (177), hydraulic low pressure connector (178) and the electric connector (190).

In FIGS. 1 and 2, the hydraulic lines and electric connections are illustrated in one plane. However, these lines and connections may be implemented in three dimensions to make the linear actuator more compact.

Figure 3:
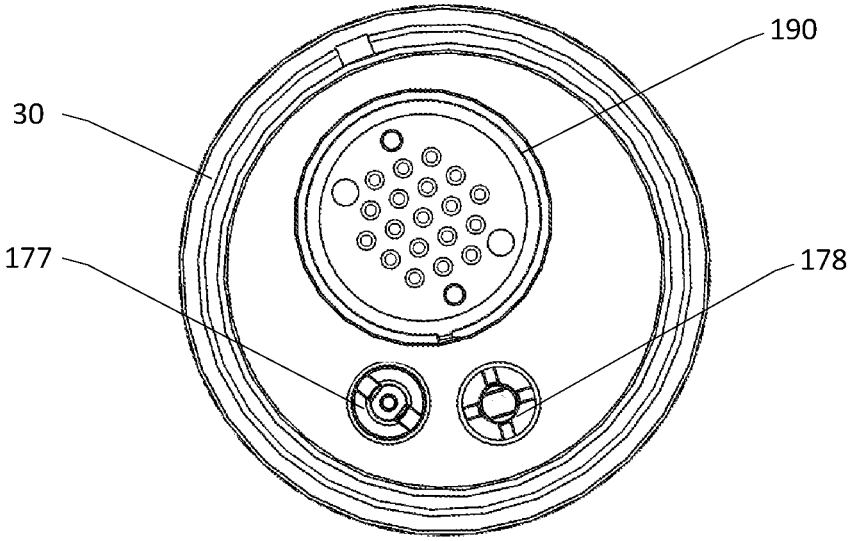
FIG. 3 illustrates in a section view, a tool interface according to an embodiment of the invention.

FIG. 3 illustrates in a section view a tool interface of the linear actuator according to the invention where the connectors of the interface are located in different longitudinal planes. In this embodiment, the tool interface is implemented in the tool adapter (30), but it could also have been an integrated part of the linear actuator. The hydraulic high pressure connector (177), hydraulic low pressure connector (178) and the electric connector (190) are illustrated.

FIG. 1 shows a specific embodiment of the invention that can be combined with any of the embodiments above, expect where specifically referred to FIG. 2. Here the retract fluid port (62) is arranged at the first end (10*a*), and the second end (10*b*) is arranged for holding the downhole tool (3). I.e. the tool (3) will be connected to the extending end of the piston rod (41). The linear actuator (1) comprises a retract fluid line (72) arranged through the cylinder head (14) and slidingly arranged through the piston head (40). In this way the retract fluid line (72) interconnects the second chamber (13) and the retract fluid port (62). When fluid under pressure is provided from the retract fluid port (62) through the retract fluid line (72), a fluid pressure in the second chamber will act on the lower side of the piston, i.e. the second chamber (13) to retract the cylinder, provided it overcomes any retaining forces. The length of the retract fluid line (72) measured inside the cylinder bore (11) should be larger than the travelling length the piston (40) to ensure that a retract fluid connection can be established for all positions of the linear actuator.

In another embodiment of the invention that can be combined with any of the embodiments above, expect where specifically referred to FIG. 1, the retract fluid port (62) is arranged at the second end (10*b*), and the first end (10*a*) is arranged for holding the downhole tool (3). I.e. the tool (3) will be connected to the cylinder head (14). In this embodiment, a retract fluid line (72) is arranged longitudinally inside the piston rod (41), and terminating in an end of the piston rod (41), opposite the second end (10*b*), in the second chamber (13). The termination may be a lateral bore from the rod of the piston rod (41) to the longitudinal retract line as illustrated in FIG. 2. In this way the retract fluid line (72) interconnects the second chamber (13) and the retract fluid port (62), When fluid under pressure is provided from the retract fluid port (62) through the retract fluid line (72), a fluid pressure in the second chamber (13) will act on the upper side of the piston, i.e. the second chamber (13) to retract the cylinder, provided it overcomes any retaining forces.

Figure 4:
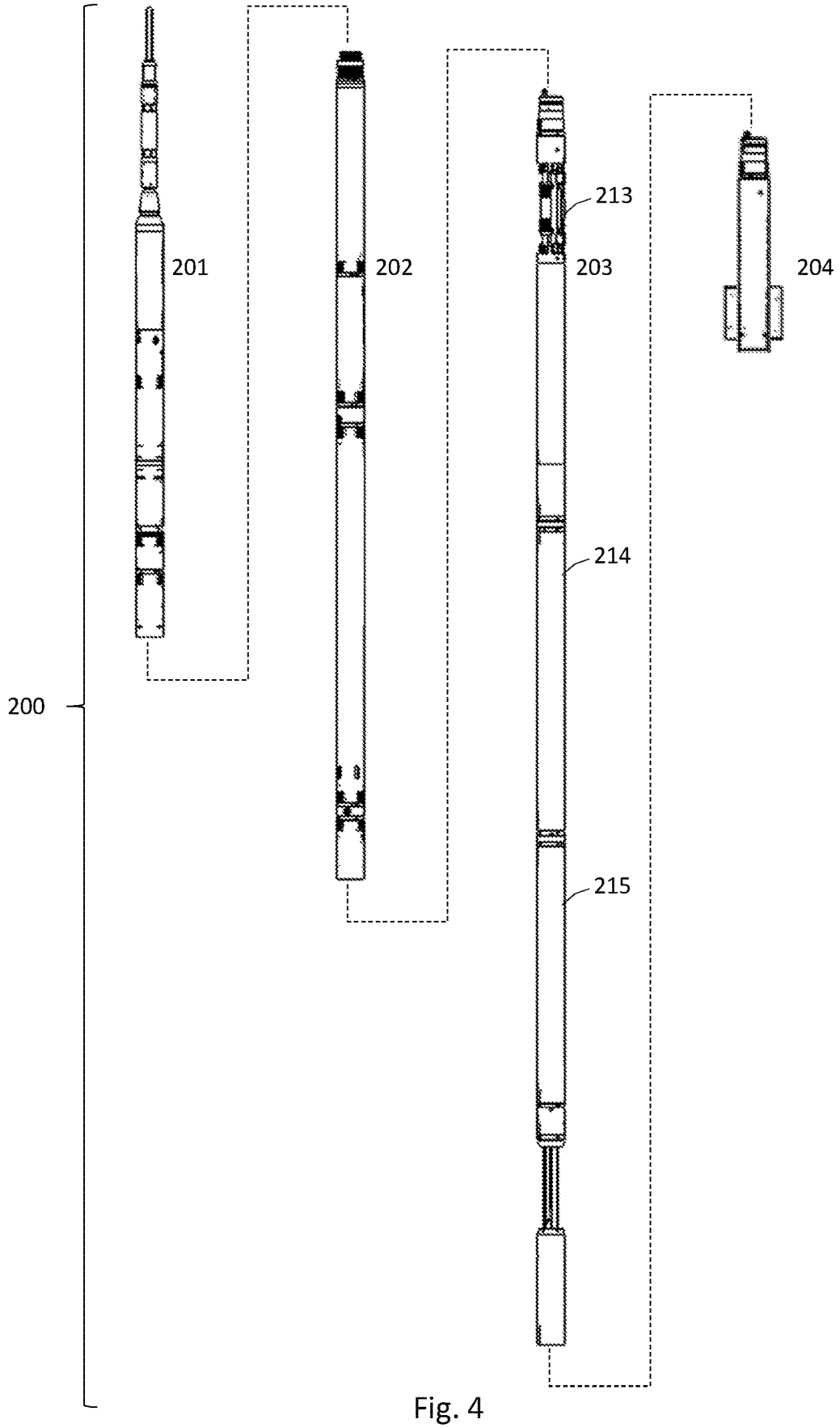
FIG. 4 illustrates a wireline tool string comprising a linear actuator according to an embodiment of the invention.

The disclosed wellbore linear actuator will usually be implemented as one or more modules in a larger tool string, e.g. a tool string (200) for milling, as illustrated in FIG. 4. Such a tool string (200) may in an embodiment be suspended from a wireline connected to a head assembly (201), comprising a release tool and a telemetry section. The head assembly may also comprise a master control module, responsible for communication with sub-ordinate control circuits in the attached modules.

Next, a hydraulic module (202) comprising the hydraulic pump and an electric motor driving the pump, is attached below the head assembly (201). The electric motor is in this embodiment powered from a surface power supply, through the wireline.

The actuator module (203) is connected below the hydraulic module (202), and comprises, in an upper part, an anchor module (213), a control section (214) comprising the fluid control circuit (60), and in the lower part, the stroker (215) comprising the double acting cylinder (10) according to the invention.

At the bottom, a key tool (204), or shifting tool, is connected to the lower end of the double acting cylinder (10). The key tool (204) is just one example of different tools that can be connected to the linear actuator.

When the hydraulic module (202) is implemented as a separate module, it has the advantage that it can be re-used in other configurations with other modules. Thus, the linear actuator, as defined previously in this document, is in the embodiment of FIG. 4 distributed over the hydraulic module (202) and the actuator module (203), However, it may also be split up differently in other embodiments.

The master control unit in the head assembly (201) is arranged to communicate with a surface device through the telemetry section.

Depending on the sensors, and processing capacity available in the toolstring, the telemetry module may send sensor data, or elaborated data from the ongoing intervention process to the surface device.

The master control unit of the invention communicates preferably digitally with its subordinate modules, i.e. digital control and monitoring signals. In the specific case of the linear actuator, the master control unit communicates with the actuator control system (100) in the control section (214).

The toolstring (200) may comprise a tractor module (not shown) between head assembly and the hydraulic module (202).

The key tool (204) of the toolstring (200) is operated with hydraulic oil under pressure from the hydraulic module (202), fed through the actuator module (203).

Thus, in a typical scenario for a shifting operation, the tool string is deployed into the wellbore until the shifting tool is close to a valve to shift. Then, the anchor (213) is set, and the stroker (215) is expanded until the key tool (204) is in the right position for shifting. This may be achieved by measuring expansion by position sensor (95). The next step is then to lock the longitudinal position of the stroker (215), as described previously, allowing pressure to be feed through the stroker (215) and further into the key tool (204).

In addition to making use of the hydraulic feed through feature, according to the invention, the key tool (204) also comprises a control circuit that communicates with the master control unit by using the electric feed through of the stroker (215). Thus, hydraulic pressure in the key tool (204) may then be controlled by the electric circuit.

The invention claimed is:

1. A wellbore linear actuator with hydraulic feed through comprising:

a double acting cylinder with a cylinder bore, wherein the double acting cylinder comprises:

a cylinder head;

a cylinder cap opposite said cylinder head;

a piston head; and a piston rod, wherein said piston head separates said cylinder bore into a first chamber and a second chamber, and said piston rod extends out of said second chamber through said cylinder cap, wherein said double acting cylinder has a first end at the cylinder head and a second end at the external end of the piston rod, and wherein said double acting cylinder further comprises:

a feed fluid passage between said first and second ends, wherein said feed fluid passage comprises:

a first fluid line through said piston head and said piston rod;

said first chamber; and a second fluid line through said cylinder head.

2. The wellbore linear actuator according to claim 1, further comprising a tool drain line between said first and second ends, wherein said tool drain line is arranged through said cylinder head, said piston head, and said piston rod, and wherein said tool drain line comprises first and second telescoping tubular elements.

3. The wellbore linear actuator according to claim 1, further comprising an actuate fluid port arranged at said first or second end, wherein the other of said first or second end is arranged for holding a downhole tool, wherein said wellbore linear actuator is arranged for feed-through of hydraulic fluid from said actuate fluid port to said downhole tool.

4. The wellbore linear actuator according to claim 3, further comprising:

a fluid pump; and a fluid control circuit interconnecting said fluid pump and said actuate fluid port and arranged for opening and closing a fluid passage between said fluid pump and said first chamber to provide pressurized fluid to said tool and to extend said double acting cylinder when in an open position.

5. The wellbore linear actuator according to claim 4, wherein said wellbore linear actuator comprises a fluid reservoir, and wherein said fluid control circuit interconnects said fluid reservoir and said actuate fluid port, and is further arranged for simultaneously opening a fluid passage between said fluid reservoir and said first chamber and for closing said fluid passage between said fluid pump and said first chamber to allow said double acting cylinder to retract.

6. The wellbore linear actuator according to claim 5, wherein said control circuit comprises an actuate drain valve arranged for opening and closing said fluid passage between said fluid reservoir and said first chamber.

7. The wellbore linear actuator according to claim 5, further comprising a retract fluid port arranged at said first or second end, wherein said double acting cylinder further comprises a retract fluid passage between said retract fluid port and said second chamber.

8. The wellbore linear actuator according to claim 7, wherein said fluid control circuit interconnects said fluid pump and said retract fluid port and is arranged for opening and closing said retract fluid passage between said fluid pump and said second chamber to actively retract said double acting cylinder.

9. The wellbore linear actuator according to claim 7, wherein said control circuit comprises a retract valve arranged for opening and closing said retract fluid passage between said fluid pump and said second chamber.

10. The wellbore linear actuator according to claim 9, wherein said control circuit comprises a retract drain valve arranged for opening and closing a retract drain fluid passage between said fluid reservoir and said second chamber.

11. The wellbore linear actuator according to claim 10, wherein said fluid control circuit is further arranged for simultaneously opening said retract drain fluid passage between said fluid reservoir and said second chamber and for closing said fluid passage between said fluid pump and said second chamber to allow said double acting cylinder to extend.

12. The wellbore linear actuator according to claim 11, wherein said fluid control circuit is arranged for simultaneously opening said actuate valve and said retract drain valve and for closing said retract valve and said actuate drain valve to extend said double acting cylinder.

13. The wellbore linear actuator according to claim 11, wherein said fluid control circuit is arranged for simultaneously opening said retract valve and said actuate drain valve and for closing said actuate valve and said retract drain valve to retract said double acting cylinder.

14. The wellbore linear actuator according to claim 11, wherein said fluid control circuit is arranged for simultaneously opening said actuate valve and for closing said retract valve, said actuate drain valve and said retract drain valve, to feed fluid under pressure to said tool.

15. The wellbore linear actuator of claim 14, wherein said fluid control circuit comprises:

a retract solenoid valve arranged to control said retract valve and said actuate drain valve;

a tool pressure solenoid valve arranged to enable or disable opening of said retract drain valve; and an actuate solenoid valve arranged to control said actuate valve and said retract drain valve when said retract drain valve is enabled, and control said actuate valve when said retract drain valve is disabled.

16. The wellbore linear actuator of claim 15, further comprising a telescopic position sensor, arranged through said first and second telescoping tubular elements, and arranged to provide an output value corresponding to a longitudinal position of said piston head within said cylinder bore.

17. The wellbore linear actuator of claim 9, further comprising an electric connection through said first and second telescoping tubular elements, interconnecting first and second electric terminations arranged in said first and second ends, respectively.

18. The wellbore linear actuator of claim 17, wherein said electric connection is a helical wire.

19. The wellbore linear actuator according to claim 4, wherein said control circuit comprises an actuate valve arranged for opening and closing said fluid passage between said fluid pump and said first chamber.

20. The wellbore linear actuator according to claim 1, wherein a retract fluid port is arranged at said first end, and said second end is arranged for holding a downhole tool, and wherein said wellbore linear actuator comprises a retract fluid line arranged through said cylinder head and slidingly arranged through said piston head, wherein said retract fluid line interconnects said second chamber and said retract fluid port.

21. The wellbore linear actuator according to claim 1, wherein a retract fluid port is arranged at said second end, and said first end is arranged for holding a downhole tool, and wherein said wellbore linear actuator comprises a retract fluid line longitudinally arranged inside said piston rod, and terminating in an end of said piston rod, opposite said second end, in said second chamber, wherein said retract fluid line interconnects said second chamber and said retract fluid port.

22. The wellbore linear actuator according to claim 1, wherein said first fluid line or said second fluid line comprises a hydraulic valve arranged to open and close said feed fluid passage between said first chamber and a tool.

23. The wellbore linear actuator according to claim 22, further comprising an electric connection through said first and second telescoping tubular elements, interconnecting first and second electric terminations arranged in said first and second ends, respectively, wherein a control port of said hydraulic valve is connected to a actuator control system via said electric connection.

24. A method for providing hydraulic fluid from a hydraulic pump to a tool connected to respective first and second ends of a wellbore linear actuator, the wellbore linear actuator comprising:

a double acting cylinder with a cylinder bore, wherein said double acting cylinder comprises:

a cylinder head;

a cylinder cap opposite said cylinder head;

a piston head; and a piston rod, wherein said piston head separates said cylinder bore into a first chamber and a second chamber, and said piston rod extends out of said second chamber through said cylinder cap, wherein said cylinder head is at said first end and an external end of said piston rod is at said second end, wherein said method comprises:

closing a fluid passage between said first chamber and said tool and opening a fluid passage between said hydraulic pump and said first chamber to expand said wellbore linear actuator into position; and opening said fluid passage between said first chamber and said tool to provide hydraulic fluid to said tool.

25. The method of claim 24, further comprising:

opening a fluid passage between said second chamber and a fluid reservoir, to expand said wellbore linear actuator into position; and closing said fluid passage between said second chamber and said fluid reservoir, to provide hydraulic fluid to said tool.

* * * * *